US006638111B1

(12) United States Patent
McDaid et al.

(10) Patent No.: US 6,638,111 B1
(45) Date of Patent: Oct. 28, 2003

(54) BOARD MOUNTED ELECTRICAL CONNECTOR WITH IMPROVED GROUND TERMINALS

(75) Inventors: Padrig McDaid, Limerick (IR); Kent D. Waddell, Co Clare (IR); Denise Brennan, Limerick (IR); Eugene Folan, Galway (IR); John M. Horgan, Limerick (IR); Enda Kelly, Clare (IR); Joseph McCarthy, Limerick (IR); Brian Murphy, Limerick (IR); John Wallace, Limerick (IR)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/193,037

(22) Filed: Jul. 11, 2002

(51) Int. Cl.[7] ..... H01R 13/648
(52) U.S. Cl. ..... 439/608; 439/108
(58) Field of Search ..... 439/108, 608, 439/609, 95, 101

(56) References Cited

U.S. PATENT DOCUMENTS

| | | | | | |
|---|---|---|---|---|---|
| 4,802,860 | A | * | 2/1989 | Kikuta | 439/79 |
| 4,826,442 | A | * | 5/1989 | Douty et al. | 439/92 |
| 5,046,952 | A | * | 9/1991 | Cohen et al. | 439/63 |
| 5,046,960 | A | | 9/1991 | Fedder | 439/108 |
| 5,286,212 | A | | 2/1994 | Broeksteeg | 439/108 |
| 5,342,211 | A | | 8/1994 | Broeksteeg | 439/108 |
| 5,346,404 | A | * | 9/1994 | Shimada | 439/108 |
| 5,377,077 | A | | 12/1994 | Burns | 361/704 |
| 5,496,183 | A | | 3/1996 | Soes et al. | 439/79 |
| 5,664,968 | A | | 9/1997 | Mickievicz | 439/608 |
| 5,735,696 | A | | 4/1998 | Niitsu et al. | 439/65 |
| 5,795,191 | A | | 8/1998 | Preputnick et al. | 439/608 |
| 6,183,302 | B1 | | 2/2001 | Daikuhara et al. | 439/608 |
| 6,247,970 | B1 | * | 6/2001 | Ueno et al. | 439/608 |
| 6,293,827 | B1 | | 9/2001 | Stokoe | 439/608 |
| 6,347,962 | B1 | | 2/2002 | Kline | 439/608 |
| 6,350,134 | B1 | * | 2/2002 | Fogg et al. | 439/79 |
| 6,461,202 | B2 | * | 10/2002 | Kline | 439/701 |

* cited by examiner

*Primary Examiner*—Lynn Feild
*Assistant Examiner*—Hae Moon Hyeon
(74) *Attorney, Agent, or Firm*—Stephen Z. Weiss

(57) ABSTRACT

An electrical connector is provided for mounting on a printed circuit board and includes an elongated dielectric housing having a front mating end and a rear terminating end. A plurality of signal terminals are mounted on the housing and are spaced longitudinally thereof. Each signal terminal includes a contact portion at the mating end of the housing and a tail portion at the terminating end of the housing. A plurality of ground plates are mounted on the housing between at least some of the signal terminals. Each ground plate includes a body portion, a front portion and a tail portion. The signal terminals are disposed substantially within the longitudinal profiles of the body portions and front portions of the ground plates in a direction longitudinally of the housing, with the tail portions of the ground plates projecting rearwardly of the profiles.

16 Claims, 4 Drawing Sheets

BOARD MOUNTED ELECTRICAL CONNECTOR WITH IMPROVED GROUND TERMINALS

FIELD OF THE INVENTION

This invention generally relates to the art of electrical connectors and, particularly, to a connector for mounting on a printed circuit board and including ground terminals or plates disposed between a plurality of signal terminals.

BACKGROUND OF THE INVENTION

A conventional surface mount electrical connector for mounting on a printed circuit board includes an insulative or dielectric housing having a plurality of conductive terminals arranged within the housing in a predetermined spacing, such as in one or more rows. Each of the terminals has a solder tail projecting from the housing to a surface of the printed circuit board. The solder tails are fixed to conductive circuit traces on the circuit board by soldering techniques.

In certain surface mount input/output (I/O) electrical connectors, ground terminals or plates are disposed between at least some of the signal terminals in order to control impedance and to reduce cross-talk between the signal terminals. The ground terminals or plates also have solder tails for connection to appropriate ground circuit traces on the printed circuit board. The ground plates are sized and shaped either to be mirror images of the signal terminals, or the signal terminals are disposed substantially within longitudinal profiles of the ground plates in order to eliminate or at least reduce cross-talk between the terminals. When the ground plates have solder tails for connection to the ground circuit traces on the printed circuit board, either the solder tails lack sufficient flexibility or they do not provide a true mirror image of the signal terminals. The present invention is directed to solving these problems with improved ground terminals or plates in such surface mounted electrical connectors.

SUMMARY OF THE INVENTION

An object, therefore, of the invention is to provide a new and improved electrical connector of the character described for mounting on a printed circuit board.

In the exemplary embodiment of the invention, the connector includes an elongated dielectric housing having a front mating end and a rear terminating end. A plurality of signal terminals are mounted on the housing and are spaced longitudinally thereof. Each signal terminal includes a contact portion at the mating end of the housing for contacting an appropriate terminal of a complementary connecting device, and a tail portion at the terminating end of the housing for connection to an appropriate signal circuit trace on the printed circuit board. A plurality of ground plates are mounted on the housing between at least some of the signal terminals. Each ground plate includes a body portion, a front portion projecting forwardly of the body portion at the mating end of the housing, and a tail portion projecting rearwardly of the body portion at the terminating end of the housing for connection to an appropriate ground trace on the printed circuit board. The signal terminals are disposed substantially within the longitudinal profiles of the body portions and front portions of the ground plates in a direction longitudinally of the housing, with the tail portions of the ground plates projecting rearwardly of the profiles.

The invention contemplates that the contact portions of the signal terminals be substantially within the longitudinal profiles of the front portions of the ground plates longitudinally of the housing. The tail portions of the signal terminals are substantially within the longitudinal profiles of the body portions of the ground plates longitudinally of the housing.

As disclosed herein, the dielectric housing defines a right-angled configuration of the electrical connector. The contact portions and front portions of the signal terminals and ground terminals, respectively, extend at right angles to the respective tail portions thereof. The signal terminals are mounted in pairs spaced longitudinally of the housing, and the ground plates are disposed on the housing between adjacent pairs of the signal terminals. The tail portions of the signal terminals and ground plates include surface-mounting feet for connection to the circuit traces and ground traces on the printed circuit board.

According to one aspect of the invention, the contact portions of the signal terminals are disposed in two spaced rows longitudinally of the housing for receiving a plug-type connecting device between the rows of contact portions. The front portions of the ground plates are bifurcated to define a pair of spaced arms for receiving at least a portion of the connecting device therebetween. The contact portions of the signal terminals are substantially within the longitudinal profiles of the spaced arms of the ground plates.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
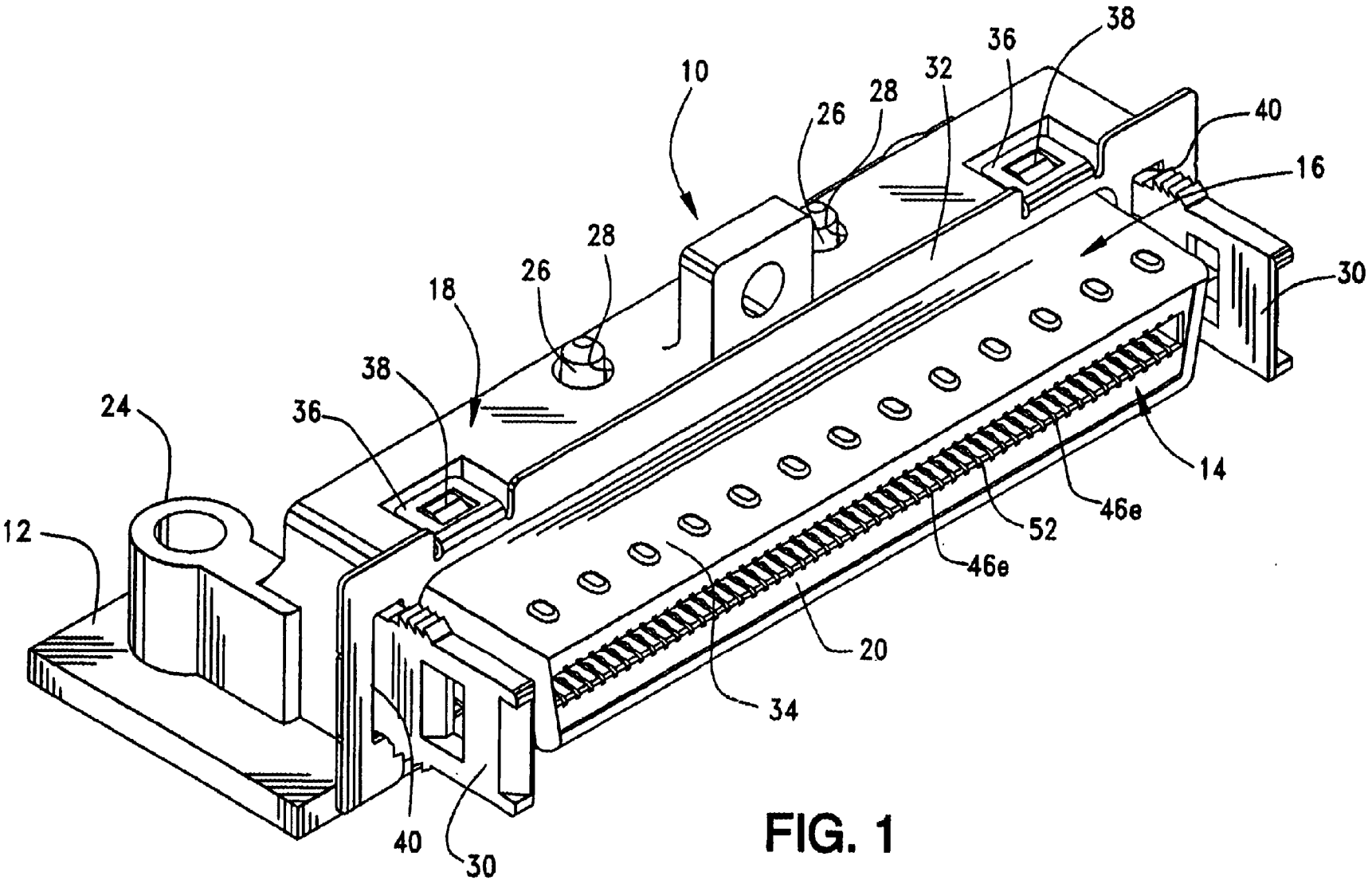
FIG. 1 is a perspective view looking at the front mating end of an electrical connector embodying the concepts of the invention, the connector being mounted on a circuit board.
Figure 2:
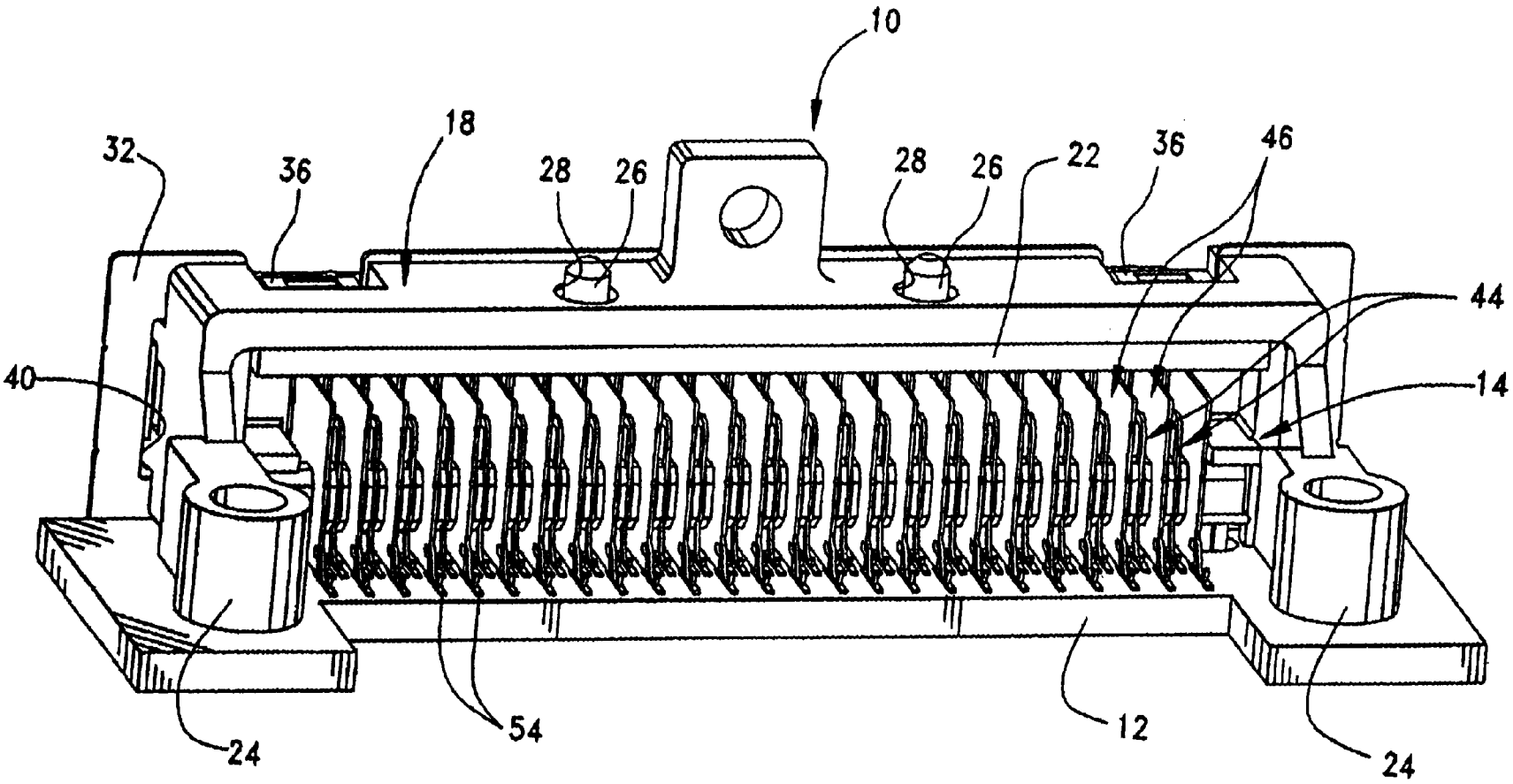
FIG. 2 is a perspective view looking at the rear terminating end of the connector.

Referring to the drawings in greater detail, and first to FIGS. 1 and 2, a right-angled electrical connector, generally designated 10, is shown for mounting on a circuit board 12. The connector includes an elongated insulating or dielectric housing, generally designated 14, which is substantially surrounded by a metal shield, generally designated 16, and a mounting component, generally designated 18. The housing defines a front mating end 20 (FIG. 1) of the connector and a rear terminating end 22 (FIG. 2) of the connector.

Mounting component 18 of connector 10 includes a pair of apertured mounting bosses 24 for receiving appropriate fasteners (not shown) for mounting the connector on circuit board 12. Housing 14 includes a pair of posts 26 which are positioned in and project upwardly through a pair of positioning holes 28 in mounting component 18. The mounting component includes a pair of forwardly projecting latch arms 30 (FIG. 1) for latching connector 10 to an appropriate latch means of a complementary mating connector or other connecting device.

Metal shield 16 of connector 10 may be stamped and formed of sheet metal material. The shield includes a plate portion 32 for abutting against the front face of the mid section of housing 14, as well as a shroud portion 34 (FIG. 1) which surrounds mating end 20 of the housing. The shield has a pair of snap latches 36 projecting rearwardly from the top and bottom edges of plate portion 32 for engaging snap-latch bosses 38 on housing 14. Lastly, the shield has a pair of vertically elongated slots 40 formed in plate portion 32 at opposite ends of shroud portion 34, through which latch arms 30 of mounting component 18 project.

Figure 3:
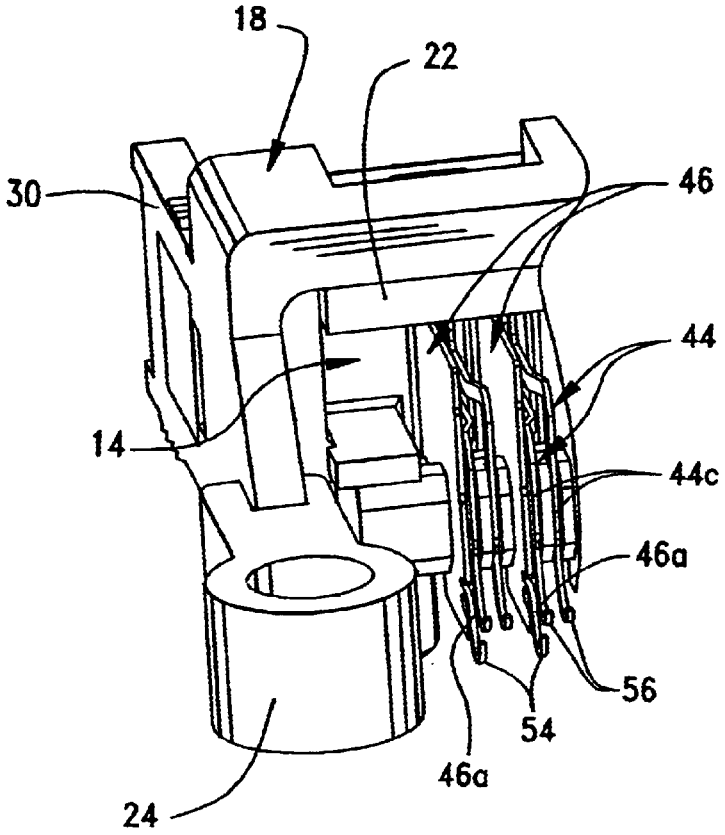
FIG. 3 is an enlarged perspective view looking at a portion of the terminating end of the connector.
Figure 4:
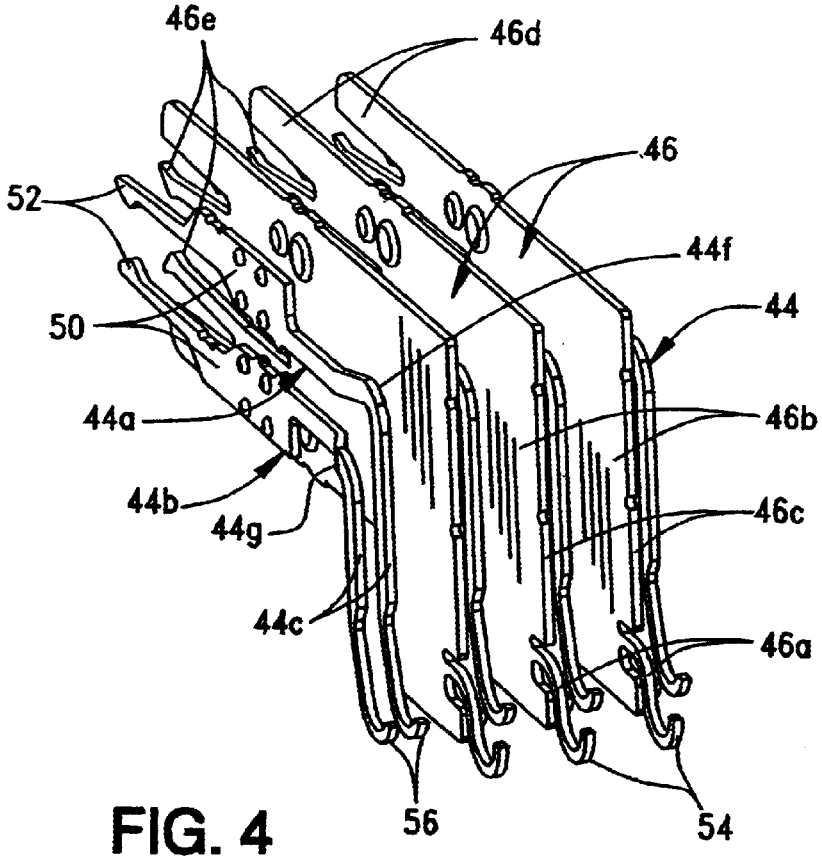
FIG. 4 is a perspective view of several of the ground plates disposed between pairs of signal terminals, with the connector housing removed to facilitate the illustration.

Referring to FIGS. 3 and 4 in conjunction with FIG. 2, a plurality of signal terminals, generally designated 44, are mounted on housing 14, spaced longitudinally of the housing, between a plurality of ground plates, generally designated 46. In other words, one ground plate 46 is disposed between adjacent pairs of signal terminals 44. As seen best in FIG. 3, signal terminals 44 have tail portions 44*c* for connection, as by soldering, to appropriate signal circuit traces on printed circuit board 12. Ground plates 46 have flexible tail portions 46*a* for connection, as by soldering, to appropriate ground traces on the printed circuit board. It should be understood that the depiction in FIG. 4 is not realistic to the extent that the signal terminals and ground plates, obviously, must be mounted in and supported by the housing. The depiction of FIG. 4 is for purposes of showing the adjacent positioning of the signal terminals and ground plates.

Figure 5:
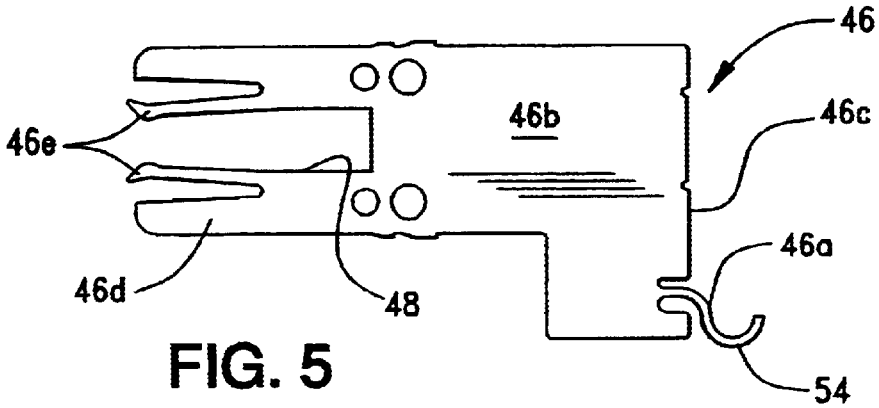
FIG. 5 is a side elevational view of one of the ground plates.

FIG. 5 shows a single ground plate 46 to include a body portion 46*b* having a rear edge 46*c* from which flexible tail portion 46*a* projects rearwardly. The body portions mount the ground plates in the housing. A front portion 46*d* of each ground plate is bifurcated to define a slot 48, with a pair of flexible contact arms 46*e* disposed at opposite sides (top and bottom) of the slot.

Figure 6:
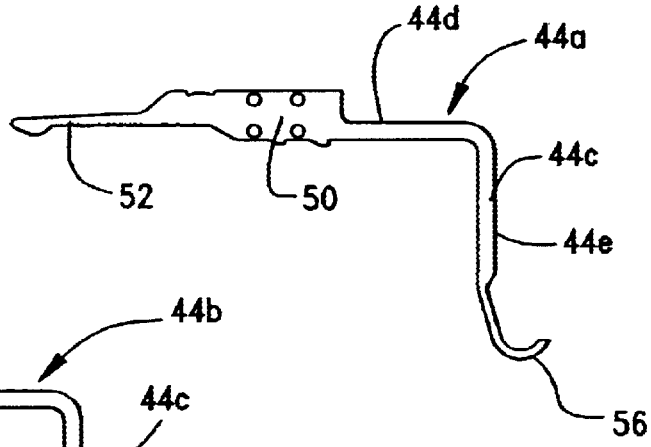
FIG. 6 is a side elevational view of one of the top signal terminals.
Figure 7:
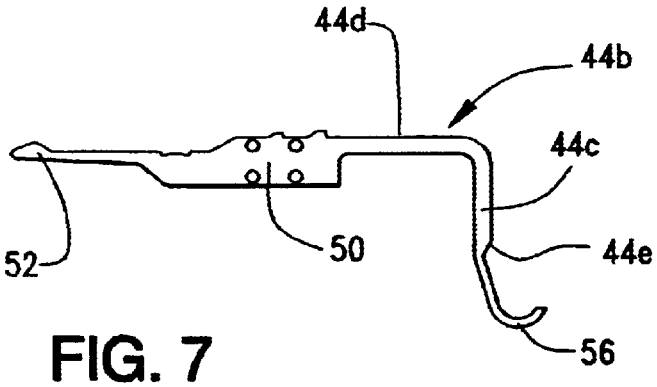
FIG. 7 is a side elevational view of one of the bottom signal terminals.
Figure 8:
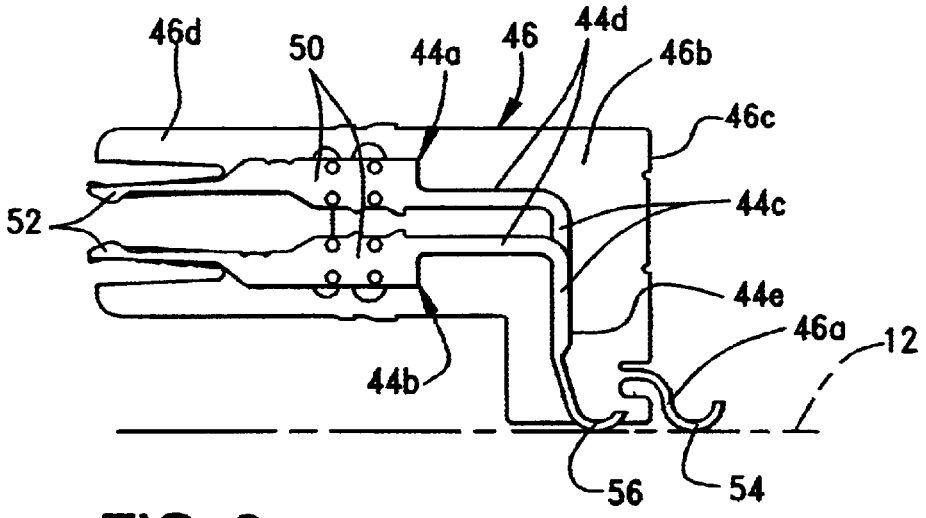
FIG. 8 is a side elevational view of a pair of signal terminals and a ground plate isolated from the connector housing to show the respective longitudinal profiles thereof.

Referring to FIGS. 6 and 7, signal terminals 44 include a top terminal 44*a* and a bottom terminal 44*b* in each pair of signal terminals disposed between a pair of ground plates 46, as described above. The top and bottom signal terminals 44*a* and 44*b*, respectively, are similar in that they include body portions 50 which provide for mounting the terminals in the connector housing. FIG. 8 shows the body portion 50 of the top and bottom signal terminals 44*a* and 44*b* located in the same plane perpendicular to the printed circuit board. Each signal terminal includes a flexible contact portion or arm 52 projecting forwardly so as to be exposed within front mating end 20 of the connector as seen in FIG. 1, for contacting an appropriate terminal of the complementary connecting device. Each signal terminal includes a tail portion 44*c* at terminating end 22 of housing 14, including a horizontal 44*d* and a vertical portion 44*e*. It can be seen that the tail portions are right-angled for the right-angled connector. One difference between top signal terminals 44*a* and bottom signal terminals 44*b* is that the vertical tail portions 44*e* of the top terminals 44*a* are longer than the vertical tail portions 44*e* of the bottom terminals so that all of the tail portions reach printed circuit board 12. Another difference is that the after the right angle bend between the horizontal tail portion 44*d* and the vertical tail portion 44*e* of the top signal terminal 44*a*, there is a second bend 44*f* which is directed to the right while the second bend 44*g* at the bottom signal terminal 44*b* is directed to the left. This arrangement of the horizontal and vertical tail portions of the top and bottom terminals allows for: further control of capacitance between the signal terminal pairs and, accordingly, further controls cross talk.

Tail portions 46*a* of ground plates 46 have feet 54, and tail portions 44*c* of signal terminals 44*a* and 44*b* have feet 56, with all of the feet of the signal terminals and the ground plates being coplanar when the terminals and plates-are mounted in the connector. Therefore, the feet surface engage the circuit traces and ground traces on printed circuit board 12 for solder connection thereto. Ground plates 46 are configured for controlling impedance and reducing cross-talk between the signal terminals in one pair thereof and the signal terminals in an adjacent pair thereof longitudinally of elongated housing 14.

To that end, and referring to FIG. 8 in conjunction with FIG. 4, it can be seen that top and bottom signal terminals 44*a* and 44*b*, respectively, are substantially within the longitudinal profiles of ground plates 46, except for the flexible tail portion 46*a* of the ground terminals which engages circuit traces on printed circuit board 12. Specifically, body portions 50 and tail portions 44*c* of the signal terminals are substantially within the longitudinal profiles of body portions 46*b* of ground plates 46. Contact arms 52 of the signal terminals are substantially within the longitudinal profiles of contact arms 46*e* of ground plates 46. In fact, when a complementary plug-type connecting device is inserted into slots 48 (FIG. 5) of the ground plates and between contact arms 52 of the top and bottom signal terminals, the contact arms of the signal terminals and the contact arms of the ground plates all flex in unison, maintaining the contact arms of the signal terminals within the longitudinal profiles of the contact arms of the ground plates. FIG. 8 shows how tail portions 46*a* of ground plates 46 project rearwardly beyond the rear edges 46*c* of the ground plates. This enables tail portions 44*c* of the signal terminals to be completely blocked in their longitudinal profiles by the massive body portions 46*b* of the ground plates longitudinally of the connector.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector for mounting on a printed circuit board, comprising:

an elongated dielectric housing having a front mating end and a rear terminating end;

a plurality of signal terminals mounted on the housing and spaced longitudinally thereof, each signal terminal including a contact portion at the mating end of the housing in a body portion for contacting an appropriate terminal of a complementary connecting device and a tail portion at the terminating end of the housing for connection to an appropriate signal circuit trace on the printed circuit board;

a plurality of ground plates mounted on the housing between at least some of said signal terminals, each ground plate including a body portion, a front portion projecting forwardly of the body portion at the mating end of the housing and a tail portion projecting rearwardly of the body portion at the terminating end of the housing for connection to an appropriate ground trace on the printed circuit board; and said signal terminals being substantially within the longitudinal profiles of the body portions and front portions of the ground plates in a direction longitudinally of the housing, with the tail portions of the ground plates projecting rearwardly of said profiles and the tail portions of the signal terminals being substantially within the longitudinal profiles of the body portions of the ground plates longitudinally of the housing.

2. The electrical connector of claim 1, wherein the contact portions of the signal terminals are substantially within the longitudinal profiles of the front portions of the ground plates longitudinally of the housing.

3. The electrical connector of claim 1, wherein said dielectric housing defines a right-angled configuration of the electrical connector, and the contact portions and front portions of the signal terminals and ground plates, respectively, extend at right angles to the respective tail portions thereof.

4. The electrical connector of claim 1, wherein the tail portions of the signal terminals and ground plates include surface-mounting feet for connection to the circuit traces and ground traces on the printed circuit board.

5. The electrical connector of claim 1, wherein said signal terminals are mounted in pairs spaced longitudinally of the housing, and the ground plates are disposed on the housing between adjacent pairs of the signal terminals.

6. The electrical connector of claim 1 wherein the contact portions of the signal terminals are disposed in two spaced rows longitudinally of the housing for receiving a plug-type connecting device between the rows of contact portions.

7. The electrical connector of claim 6 wherein the front portions of said ground plates are bifurcated to define a pair of spaced arms for receiving the connecting device therebetween.

8. The electrical connector of claim 7 wherein the contact portions of the signal terminals are substantially within the longitudinal profiles of the spaced arms of the ground plates.

9. An electrical connector for mounting on a printed circuit board, comprising:

an elongated dielectric housing having a front mating end and a rear terminating end;

a plurality of ground plates mounted on the housing and spaced longitudinally thereof, each ground plate including a body portion, a front portion projecting forwarding of the body portion at the mating end of the housing and a tail portion projecting rearwardly of the body portion at the terminating end of the housing for connection to an appropriate ground trace on the printed circuit board; and a plurality of signal terminals mounted on the housing between at least some of the ground plates, each signal terminal including a contact portion at the mating end of the housing for contacting an appropriate terminal of a complementary connecting device, the contact portions of the signal terminals being substantially within the longitudinal profiles of the front portions of the ground plates longitudinally of the housing, each signal terminal including a tail portion at the terminating end of the housing for connection to an appropriate signal circuit trace on the printed circuit board, the tail portions of the signal terminals being substantially within the longitudinal profiles of the body portions of the ground plates longitudinally of the housing.

10. The electrical connector of claim 9 wherein said dielectric housing defines a right-angled configuration of the electrical connector, and the contact portions and front portions of the signal terminals and ground plates, respectively, extend at right angles to the respective tail portions thereof.

11. The electrical connector of claim 9 wherein the tail portions of the signal terminals and ground plates include surface-mounting feet for connection to the circuit traces and ground traces on the printed circuit board.

12. The electrical connector of claim 9 wherein said signal terminals are mounted in pairs spaced longitudinally of the housing, and the ground plates are disposed on the housing between adjacent pairs of the signal terminals.

13. The electrical connector of claim 9 wherein the contact portions of the signal terminals are disposed in two spaced rows longitudinally of the housing for receiving a plug-type connecting device between the rows of contact portions.

14. The electrical connector of claim 13 wherein the front portions of said ground plates are bifurcated to define a pair of spaced arms for receiving the connecting device therebetween.

15. The electrical connector of claim 14 wherein the contact portions of the signal terminals are substantially within the longitudinal profiles of the spaced arms of the ground plates.

16. An electrical connector for mounting on a printed circuit board, comprising:

an elongated dielectric housing having a front mating end and a rear terminating end;

a plurality of signal terminals mounted on the housing and spaced longitudinally thereof, each signal terminal including a contact portion at the mating end of the housing in a body portion for contacting an appropriate terminal of a complementary connecting device and a tail portion at the terminating end of the housing for connection to an appropriate signal circuit trace on the printed circuit board the signal terminals being mounted in a pair including a top and bottom signal terminal, the body portion and the contact portion of the signal terminals located in a single plane perpendicular to the printed circuit board;

a plurality of ground plates mounted on the housing between at least some of said signal terminals, each ground plate including a body portion, a front portion projecting forwardly of the body portion at the mating end of the housing and a tail portion projecting rearwardly of the body portion at the terminating end of the housing for connection to an appropriate ground trace on the printed circuit board, the signal terminals being mounted in a pair including a top and bottom signal terminal, the body portion and the contact portion of the signal terminals located in a single plane perpendicular to the printed circuit board; and said signal terminals being substantially within the longitudinal profiles of the body portions and front portions of the ground plates in a direction longitudinally of the housing, with the tail portions of the ground plates projecting rearwardly of said profiles and the tail portion of the signal terminals including a horizontal and vertical portion joined by a right angle bend and a lateral bend, the lateral bend of the top and bottom signal terminals being opposite one another allowing the tail portions of the signal terminals to be located in planes different from said single plane.

* * * * *